US005537930A

United States Patent [19]

Van Lierde

[11] Patent Number: 5,537,930

[45] Date of Patent: Jul. 23, 1996

[54] METHOD FOR HAULING CONVEYOR UNITS FROM A MAIN TRACK TO A SHUNTING TRACK IN A FLOOR CHAIN HAULAGE SYSTEM

[75] Inventor: Carlos Van Lierde, Kalken, Belgium

[73] Assignee: Elektriciteit Voor Goederenbehandeling Marine En Industrie, in het verkort Egemin, naamloze vennootschap, Belgium

[21] Appl. No.: 400,576

[22] Filed: Mar. 8, 1995

[30] Foreign Application Priority Data

Mar. 8, 1994 [BE] Belgium ..... 9400251

[51] Int. Cl.[6] ..... B61B 7/00

[52] U.S. Cl. ..... 104/172.3; 198/367

[58] Field of Search ..... 104/173.3, 172.2, 104/172.1, 172.4, 88; 198/367, 442

[56] References Cited

U.S. PATENT DOCUMENTS

| | | | |
|---|---|---|---|
| 3,521,568 | 7/1970 | Kato et al. . | |
| 3,648,618 | 3/1972 | Pierson et al. . | |
| 4,703,844 | 11/1987 | Jahns | 198/367 |
| 5,029,693 | 7/1991 | Williams | 198/367 |
| 5,186,306 | 2/1993 | Sjostrand | 198/367 |

FOREIGN PATENT DOCUMENTS 964022 7/1964 United Kingdom .

*Primary Examiner*—Robert J. Oberleitner
*Assistant Examiner*—C. T. Bartz
*Attorney, Agent, or Firm*—Bacon & Thomas

[57] ABSTRACT

During the haulage of a conveyor unit (3), a floor chain (6) of a shunting track (2) is moved over a pitch distance (PZ) which is slightly larger than the length of a conveyor unit (3) and which is selected such that, after the movement, a catch element (7) is in a position ready to carry along a pin (11) of a subsequent conveyor unit (3) to be hauled, until the conveyor unit (3) reaches an intermediate position whereby it is still situated with a portion thereof in the path (14) of the conveyor units (3) which have not been hauled. When the subsequent conveyor unit (3) must also be hauled, the floor chain (6) of the shunting track (2) is again moved over the above-mentioned pitch distance (PZ). When the subsequent conveyor unit (3) has to further follow the main track (1), the floor chain (6) of the shunting track (2) is moved over such an intermediate distance (X) that the conveyor unit (3) in the intermediate position is brought outside the path (14) of the conveyor units (3) which have not been hauled, after which the floor chain (6) is moved in the reverse direction over a return distance (Y) until the catch element (7), which would normally carry along the pin of a subsequent conveyor unit (3) to be hauled, is in the position in which it is ready to carry along the pin (11) of such a subsequent conveyor unit (3), whereby the conveyor units (3) are released by the catch elements (7) on the shunting track (2).

5 Claims, 2 Drawing Sheets

METHOD FOR HAULING CONVEYOR UNITS FROM A MAIN TRACK TO A SHUNTING TRACK IN A FLOOR CHAIN HAULAGE SYSTEM

BACKGROUND OF THE INVENTION

The invention concerns a method for hauling conveyor units from a main track to a shunting track in a floor chain haulage system, which shunting track contains a part which is directed diagonally onto the main track which is connected onto the main track at the height of a switch and a shunting part which is directed for example parallel to this main track, according to which method the conveyor units are moved over the main track or the shunting track by means of a driven floor chain and catch elements mounted there upon which can carry along a pin of a conveyor unit to be moved and whereby it is determined by means of the switch whether the conveyor unit goes straight ahead or is hauled on the shunting track.

In order to haul a conveyor unit the switch is put in the required position and the floor chain of the shunting track is moved over a distance. Because the shunting track has only one floor chain, the conveyor units which are already shunted are also moved over the same distance. Without any special measures, the hauled Conveyor units must be moved over such a distance on the Shunting track that they are situated entirely outside the path of the conveyor units which follow the main track straight on. Because the part of the shunting track which is connected onto the main track forms an angle, usually of 45 degrees, with the main track, this distance is relatively large, as a result of which also the distance between the conveyor units which are shunted on the actual shunting part is relatively large and in any case larger than necessary to shunt the conveyor units safely without any risk of colliding.

This implies that the number of conveyor units to be shunted is not optimal for a given length of the shunting track.

In order to remedy this problem somewhat, it is already known to drive the floor chain of the shunting track continuously, but to temporarily disconnect the coupling between the pins of the already shunted conveyor units and the catch elements during the haulage, such that the shunted conveyor units are moved over a shorter distance than the floor chain. However, this method requires complicated and expensive coupling and decoupling mechanisms.

Other solutions to increase the shunting capacity include using two floor chains for the shunting track whereby either the two floor chains are driven separately, which requires two drive devices, or one floor chain is driven directly and the other floor chain indirectly, which requires also a transmission system between the two floor chains apart from a drive.

Consequently, these solutions are expensive.

SUMMARY OF THE INVENTION

The invention aims to remedy the disadvantages and to provide a method for hauling conveyor units from a main track to a shunting track in a floor chain haulage system which, on the one hand, can be applied with a relatively simple shunting track with one single floor chain and thus only one drive and without any complicated decoupling mechanisms, but which, on the other hand, makes it possible to shunt a relatively large number of conveyor units for a given length of the shunting track.

This aim is reached according to the invention because the floor chain of the shunting track is moved as follows:

a) during the haulage of a conveyor unit, the floor chain of the shunting track and thus the catch element which carries along the pin of this conveyor unit are moved over a pitch distance which is slightly larger than the length of a conveyor unit and which is selected such that, after the movement, another catch element is in a position ready to carry along a pin of a subsequent conveyor unit to be hauled, until the conveyor unit reaches an intermediate position whereby it is still situated with a part in the path of the conveyor units which have not been hauled, whereby conveyor units which have already been shunted are shifted over the same pitch distance;

b) when the subsequent conveyor unit which is presented to the switch on the main track must also be hauled, the floor chain of the shunting track is again moved over the above-mentioned distance, whereby the new conveyor unit ends up in the intermediate position and the other conveyor units shift on the shunting track over said distance and a new catch element is ready to carry along the pin of a subsequent conveyor element to be hauled; however, c) when the subsequent conveyor unit which is presented to the switch on the main track has to further follow the main track, the floor chain of the shunting track is moved over such an intermediate distance that the conveyor unit in the intermediate position is brought outside the path of the conveyor units which have not been hauled, which intermediate distance is smaller than said pitch distance, whereby the already shunted conveyor units are moved along over this intermediate distance, after which the floor chain is moved in the opposite sense over a return distance until the catch element, which should normally carry along the pin of a subsequent conveyor unit to be hauled but which has been moved forward by said intermediate distance, is in the position in which it is ready to carry along the pin of such a subsequent conveyor unit, whereby the conveyor units are released by the catch elements on the shunting track; and d) during the haulage of a subsequent conveyor unit, after a preceding conveyor unit has further followed the main track, the floor chain of the shunting track is again moved forward over a distance equal to said pitch distance, whereby the new conveyor unit takes up the intermediate position and the already shunted conveyor units are only carried along after a movement which is at least equal to the return distance.

Practically, the position in which a catch element of the shunting track is ready to carry along a conveyor unit is selected such that this catch element is situated opposite the switch, so that the distance between the pin of a conveyor unit in the above-mentioned intermediate position and the switch point where the pin leaves the main track via the switch approaches the pitch distance as much as possible.

According to an advantageous embodiment of the invention, a floor chain is used for the shunting track, whereby the distance between subsequent catch elements is equal to said pitch distance.

According to a practical embodiment of the invention, the floor chain of the shunting track is driven discontinuously and the passage of the pin of a conveyor unit is detected by means of a sensor mounted in front of the switch, and during or shortly after this detection said floor chain is already started if necessary, so that during the haulage of the conveyor unit at the time of the transfer of the conveyor unit to the floor chain, the latter already has a certain speed, or so that, with a conveyor unit which does need to be hauled, the floor chain can remove the conveyor unit in the intermediate position fast enough from the path of the first-mentioned conveyor unit.

BRIEF DESCRIPTION OF THE DRAWINGS

In order to better explain the characteristics of the invention, the following preferred embodiment of a method for hauling conveyor units from a main track to a shunting track in a floor chain haulage system is given as an example only without being limitative in any way, with reference to the accompanying drawings, in which.

DETAILED DESCRIPTION OF THE PREFERRED EMBODIMENT

Figure 1:
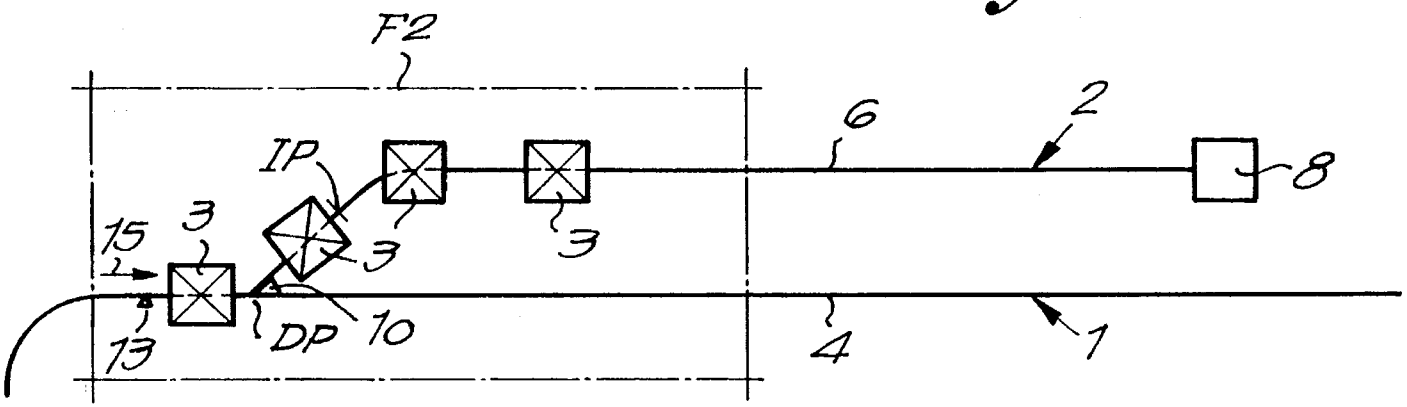
FIG. 1 is a schematic representation of a floor chain haulage system in which the method according to the invention is applied.

The floor chain haulage system which is schematically represented in FIG. 1 mainly includes of a main track 1 and a shunting track 2 for conveyor units 3.

The main track 1 consists in the known way of a floor chain 4 recessed into the floor which follows a large, closed path and which carries catch elements 5 which are situated at a constant pitch distance PH from one another. This floor chain 4 is driven continuously or discontinuously by a drive which is not represented in the figures.

The shunting track 2 consists in an analogous manner of a floor chain 6 which is provided with catch elements 7 which are situated at a constant pitch distance PZ from one another. The floor chain 6 follows a small loop which contains a part which is directed onto the main track 1 at an angle of about 45 degrees and a shunting part which in this case extends parallel to said main track 1. On both ends, this floor chain 4 runs over sprocket wheels and/or turning points of which one sprocket wheel is driven by a drive 8, for example an electric motor, and of which the other, namely the turning point 9, is situated right next to the main track 1, opposite a switch 10. The pitch distance PH may differ from the pitch distance PZ, but both pitch distances must be larger than the total length of a conveyor unit 3 whereby the pitch distance PZ must be as short as possible, so that the conveyor units 3 can be shunted as close as possible to one another.

The floor chains 4 and 6 and the catch elements 5 and 7 may be of a known design and consequently are not described in detail here. Each of the conveyor units 3 has at its front end a vertical pin 11 which can be carried along in the direction of movement of a floor chain 4 or 6 by the catch elements 5 or 7 mounted there upon. These conveyor units 3 are trolleys, pallet carriers or other mobile devices on wheels.

Also the switch 10 in the main track 1 is of a known design and may for example consist of a guiding lath which is hinge-mounted around a vertical shaft. In one position the switch 10 lets the pins 11 through, whereas in another position the switch 10 forces the pins to divert to the shunting track 2. During the haulage, the switch 10 is situated in the latter position. A pin 11 which is lead by the switch 10 onto the shunting track 2 leaves the main track 1 in the switch point DP.

At a distance before this switch point, as seen in the direction of transport of the conveyor units 3, which direction of transport is represented in the figures by the arrow 15, is erected a sensor 13 along the main track 1 with which the passage of a pin 11 is detected.

The floor chain 6 of the shunting track 2 is driven in a very special manner.

In a normal rest position, one of the catch elements 7 of the shunting track 2 is situated opposite the switch 10, just outside the main track 1 so as not to hinder the movement of this main track and/or the catch element, but ready to carry along the pin 11 of a conveyor unit 2 to be hauled if required. This situation is represented in FIG. 2.

When a conveyor unit 3 arriving on the main track 1 must be hauled on the shunting track 2, the switch 10 is put in the corresponding position. As soon as the sensor 13 detects the passage of the pin 11 of conveyor unit 3, the floor chain 6 is already started so that, when this pin 11 is just past the switch point DP, the floor chain 6 already has a maximum speed and a catch element 7 is situated right after the pin 11 to carry it further along.

The floor chain 6 is moved over a distance equal to said pitch distance PZ, between the catch elements 7, until the pin 11 is situated on the place IP and the conveyor unit 3 is in an intermediate position. Since the catch element 7 which moves the pin 11 has to cover a very short distance before it reaches the switch point DP, the distance between this switch point and the place IP is somewhat shorter than the pitch distance PZ.

Figure 2:
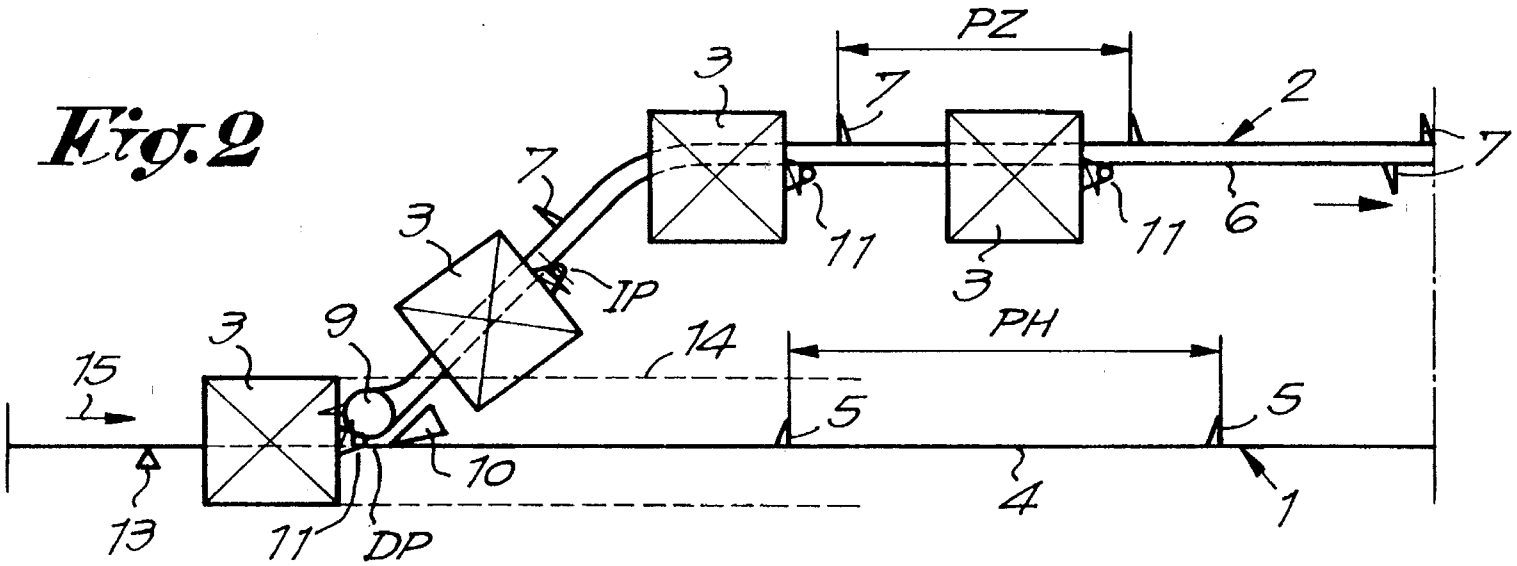
FIG. 2 is a schematic representation, but to a larger scale, of the part which is indicated in FIG. 1 by F2.

As can be clearly seen in FIG. 2, in which one of the conveyor units 3 is represented in the above-mentioned intermediate position, the back side of this conveyor unit 3 is situated in the path 14 of the conveyor units 3 which have not been hauled. This path 14 is represented in the FIGS. 2 to, 4 by means of a dashed line.

During the above-mentioned movement of the hauled conveyor unit 3 possible conveyor units 3 which have already been shunted on the shunting track shift along over the pitch distance PZ.

As the pitch distance PZ is minimal, it is clear that the hauled conveyor unit 3 is not taken past the path 14.

When a subsequent conveyor unit 3 must also be hauled, the previous cycle is repeated and the floor chain 6 is moved again over the pitch distance PZ. FIG. 2 shows a conveyor unit 3 which is about to be hauled as well.

Figure 3:
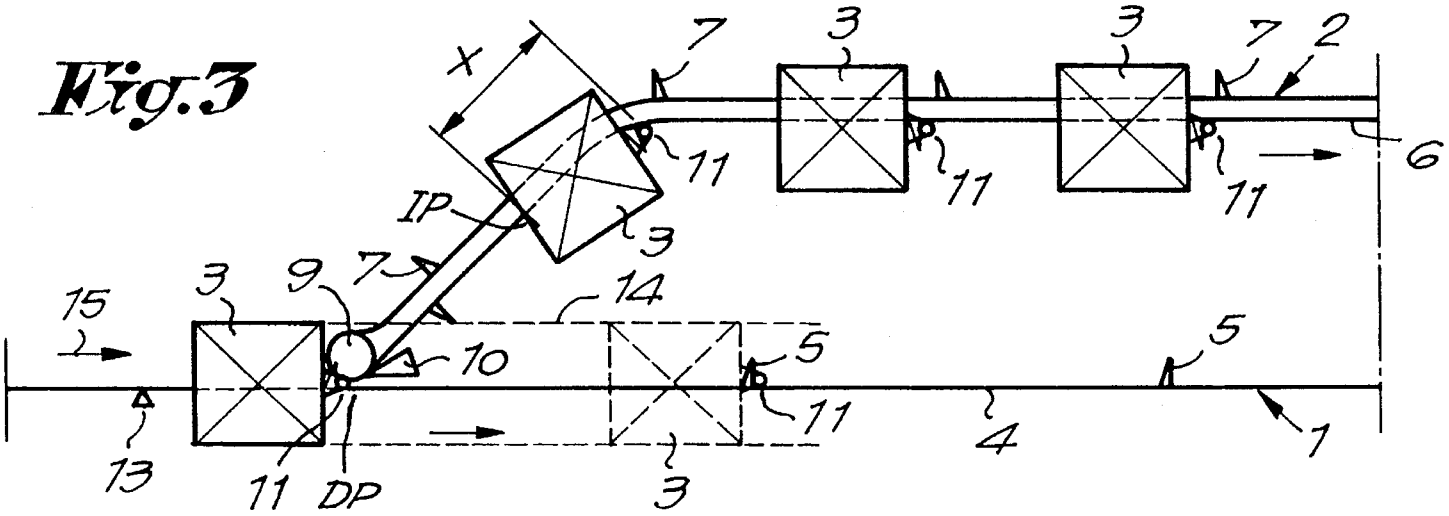
FIG. 3 represents the part of FIG. 2, but at another stage of the method according to the invention.

When the latter conveyor unit 3 does not need to be hauled but is to be moved straight ahead as represented in FIG. 3, the position of the switch 10 is of course changed so that the pin 11 of this conveyor unit 3 can go straight ahead. The floor chain 6 of the shunting track 2 is started, however, as described above, but this floor chain 6 is only moved over a smaller intermediate distance X, namely a distance which is sufficient to bring the conveyor unit 3 which is in the intermediate position outside the path 14. It is sufficient to bring this conveyor unit 3 right outside the path 14, but preferably a safety distance of about 50 cm should remain between this conveyor unit 3 and the path 14. The intermediate distance X is in any case smaller than the pitch distance PZ.

During the movement of the floor chain 6 over the intermediate distance also the other conveyor units 3 situated on the shunting track are moved forward over the same distance. The floor chain system ends up in the situation as represented in FIG. 3.

While a conveyor unit 3 is moved further straight ahead over the main track 1, the floor chain 6 of the shunting track 2 is moved backward over a return distance Y until the catch element 7 which follows the catch element which has moved the preceding conveyor unit 3 over the intermediate distance X is in the position opposite the switch 10 and ready to quickly take along the pin 11 of a subsequent conveyor unit 3 during the haulage thereof.

Figure 4:
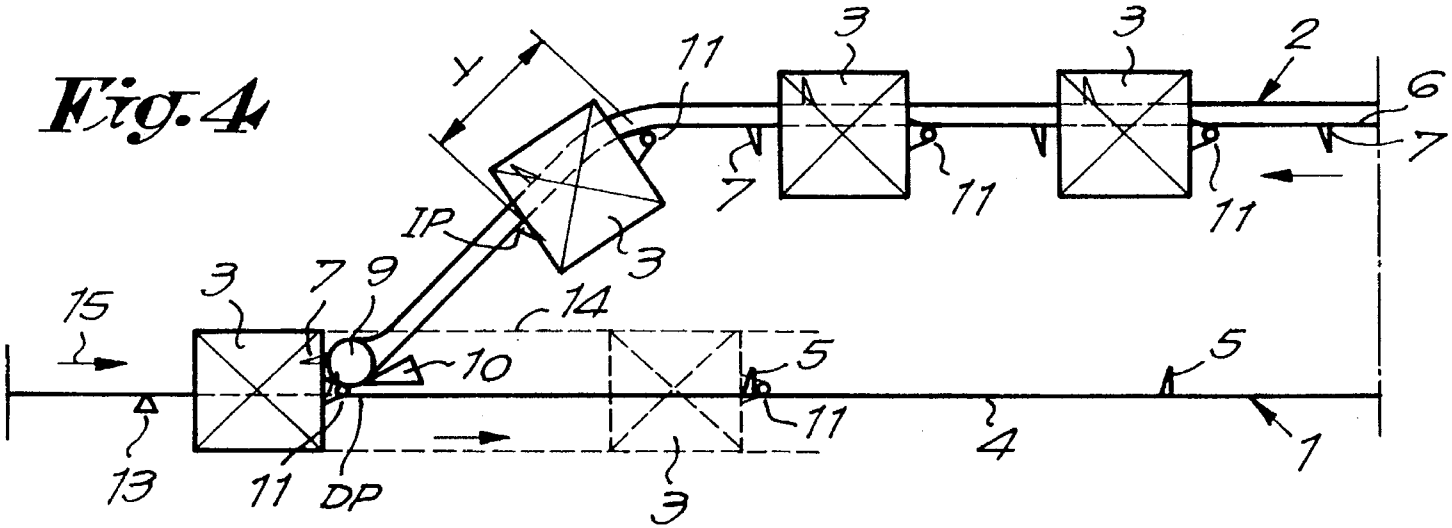
FIG. 4 represents the part of the FIGS. 2 and 3, but with reference to yet another stage of the method according to the invention.

During this backward movement of the floor chain 6, the conveyor units 3 which are situated on the shunting track 2 are released by the catch elements 7 and they do not go along backward but they remain in place or move forward a little bit as a result of the inertia. The situation as represented in FIG. 4 is obtained.

When a subsequent conveyor unit 3 which approaches the switch 10 on the main track 1 must also go straight ahead, the floor chain 6 remains standing still.

When, however, this conveyor unit must also be hauled, the floor chain 6 is moved again over a distance equal to the pitch distance PZ and the pin 11 of this conveyor unit 3 is carried along by the catch element 7 which stands ready opposite the switch 10 until the pin 11 is in the point IP and the conveyor unit 3 is in the intermediate position. During this movement of the floor chain 6, the conveyor units 3 which are already on the shunting track will initially not be moved since the catch elements 7 which push function to the conveyor unit 3 push forward have been moved backward. Only when these catch elements 7 reach their pin 11 will these conveyor units 3 be further moved over an additional distance. The sum of this additional distance and the intermediate distance X which they have covered during the latter forward movement is almost equal to the pitch distance PZ.

In this manner, with one single floor chain 6 and one single drive 9 and thus with a relatively cheap system, a maximum number of conveyor units 3 can be shunted on the shunting track.

The speed of the floor chain 6 may differ from the speed of the floor chain 4 and may also vary in time. Thus, the floor chain 6 can be driven faster backward than forward. If the speed of the floor chain 6 is sufficiently low, it could be driven continuously.

The present invention is by no means limited to the above-described embodiment represented in the accompanying drawings; on the contrary, such a method for hauling conveyor units from a main track to a side track in a floor chain haulage system may be applied in all sort of variants while still remaining within the scope of the invention.

I claim:

1. A method for hauling conveyor units (3) from a main track (1) to a shunting track (2) in a floor chain haulage system, which shunting track (2) contains a segment which is directed diagonally to the main track (1) and is connected to the main track (1) adjacent a switch (10) wherein the conveyor units (3) are moved over the main track (1) or the shunting track (2) by means of a respective driven floor chain (4 or 6) carrying catch elements (5 and 7) mounted thereupon which engage a pin (11) carried by a conveyor unit (3) to be moved and whereby it is determined by the switch (10) whether the conveyor unit (3) goes straight ahead along the main track (1) or is hauled on the shunting track (2), comprising:

a) moving, during the haulage of a first conveyor unit (3), the floor chain (6) of the shunting track (2) and thus the catch element (7) which carries along the pin (11) of said first conveyor unit (3) over a pitch distance (PZ) which is slightly larger than the length of said first conveyor unit (3) with the pitch distance (PZ) being selected such that, after the movement, another catch element (7) is arranged in a position ready to carry along a pin (11) of a subsequent conveyor unit (3) to be hauled, until said first conveyor unit (3) reaches an intermediate position whereat said first conveyor unit (3) is still situated with a portion thereof in a path (14) associated with conveyor units (3) which have not been hauled and wherein conveyor units (3) which have already been shunted are shifted over the same pitch distance (PZ);

b) again moving, when the subsequent conveyor unit (3) presented to the switch (10) on the main track (1) must be hauled, the floor chain (10) of the shunting track (2) over the said pitch distance (PZ), whereby said subsequent conveyor unit (3) ends up in the intermediate position and said first conveyor unit (3) shifts on the shunting track (2) over said distance (PZ) and a new catch element (7) is ready to carry along the pin (11) of a further subsequent conveyor unit (3) to be hauled; however, c) moving, when the subsequent conveyor unit (3) presented to the switch (10) on the main track (1) has to further follow the main track (1), the floor chain (6) of the shunting track (2) over such an intermediate distance (X) that said first conveyor unit (3) in the intermediate position is brought outside the path (14) of the conveyor units (3) which have not been hauled, which intermediate distance (X) is smaller than said pitch distance (PZ), whereby already shunted conveyor units (3) are moved along over this intermediate distance (X), after which the floor chain (6) of the shunting track (2)is moved in an opposite direction over a return distance (Y) until a catch element (7), which would normally carry along the pin of the subsequent conveyor unit (3) to be hauled but which has been moved forward by said intermediate distance (X), is in a position in which said catch element is ready to carry along the pin (11) of said subsequent conveyor unit (3), whereby the pins (11) association with each of the conveyor units (3) on the shunting track (2) are released by their associated catch elements (7); and d) again moving, during the haulage of another conveyor unit (3), after a preceding conveyor unit (3) has further followed the main track (1), the floor chain (6) of the shunting track (2) forward over a distance equal to said pitch distance (PZ), whereby said another conveyor unit (3) takes up the intermediate position and the already shunted conveyor units (3) are only carried further along said shunting track (2) after the floor chain (6) of said shunting track (2) has moved an amount at least equal to the return distance.

2. The method according to claim 1, further comprising: selecting the position in which a catch element (7) of the shunting track (2) is ready to carry along a given conveyor unit (3) such that this catch element (7) is situated opposite the switch (10), so that a distance between the pin (11) of a conveyor unit (3) located in the intermediate position and the switch point (DP) is approximately equal to said pitch distance (PZ).

3. The method according to claim 1, further comprising: setting the distance between subsequent catch elements (7) on said shunting track (2) equal to said pitch distance (PZ).

4. The method according to claim 1, further comprising: driving the floor chain (6) of the shunting track (2) discontinuously and detecting the passage of the pin (11) associated with each conveyor unit (3) by means of a sensor (13) mounted in front of the switch (10) and, during or shortly after this detection, driving said floor chain (6) so that, during the haulage of the conveyor unit (3) at the time of the transfer of said conveyor unit (3) to the floor chain (6) of the shunting track (2), the floor chain (6) of the shunting track (2) attains a certain speed and, when the subsequent conveyor unit (3) does need to be hauled, the floor chain (6) of the shunting track (2) can remove the conveyor unit (3) from the intermediate position fast enough from the path (14) of the subsequent conveyor unit (3).

5. The method according to claim 4, further comprising: maintaining the position of the floor chain (6) of the shunting track still when a number of conveyor units (3) situated directly after one another do not need to be hauled.

* * * * *